United States Patent [19]

Carbonetto

[11] Patent Number: 4,866,814

[45] Date of Patent: Sep. 19, 1989

[54] PROCESS AND APPARATUS TO FINE ONE END IN A TEXTILE FIBER BAND OR SLIVER AND TO ENGAGE SAID END TO FEED MEMBERS IN A TEXTILE MACHINE

[75] Inventor: Pier F. Carbonetto, Biella, Italy

[73] Assignee: S.P.A. Pettinatura Italiana, Biella, Italy

[21] Appl. No.: 253,234

[22] Filed: Oct. 4, 1988

[30] Foreign Application Priority Data

Mar. 22, 1988 [IT] Italy ..... 19898 A/88
Mar. 22, 1988 [IT] Italy ..... 19899 A/88

[51] Int. Cl.[4] ..... D01H 9/00; D01H 11/00
[52] U.S. Cl. ..... 19/159 A
[58] Field of Search ..... 19/159 A, 159 R; 57/266, 267, 276

[56] References Cited

U.S. PATENT DOCUMENTS 869,044 10/1907 Arnold-Forster ..... 57/267
3,083,415 4/1963 Osaki et al. ..... 19/159 A
3,681,905 8/1972 Furtmeier et al. ..... 57/267

*Primary Examiner*—Werner H. Schroeder
*Assistant Examiner*—Douglas Price
*Attorney, Agent, or Firm*—Laff, Whitesel Conte & Saret

[57] ABSTRACT

The apparatus acts on a textile fiber band or sliver (2) wound in a sliver can (3) to form primary coils helically aligned about the axis of said can to form superposed secondary coils. A grasping member (2) movable in a vertical direction raises some of said primary coils (4). A supporting member (17) is then moved close to one sliver length (28) descending from the raised coils (4) to arrange said length so that it may be disposed astride of the supporting member itself when said coils (4) are dropped into the can (3). Sliver (2) as a result of the rotation of the supporting roller (20) or as a result of the rotation of the supporting roller (17) to bring the free end (2*a*) of said sliver close to the supporting member (17). The free end (2*a*) is engaged between the feed rollers (10, 11) of a textile machine by moving the supporting roller (17) close to said feed rollers or by moving the feed rollers close to each other.

18 Claims, 16 Drawing Sheets

PROCESS AND APPARATUS TO FINE ONE END IN A TEXTILE FIBER BAND OR SLIVER AND TO ENGAGE SAID END TO FEED MEMBERS IN A TEXTILE MACHINE

BACKGROUND OF THE INVENTION

1. Field of the Invention

The present invention relates to a process and an apparatus to find one end in a textile fiber band or sliver and to engage said end to feed members in a textile machine, said sliver being collected in a sliver can and helically distributed to form primary coils consecutively aligned according to the form of a helix that is wound about the axis of said sliver can to form secondary coils consecutively superposed, said sliver ending at the top in a free end designed to be engaged to feed members in a textile machine.

In particular the process and apparatus of the invention are conceived to automatically arrange a sliver so that it may undergo suitable processings by a textile machine of the type fed from a sliver can.

2. Prior Art

It is known that for the treatment of textile fibers several operations are provided such as carding, combing, drawing and so on, which are adapted to select the fibers and arrange them so that they may undergo the subsequent spinning operations.

To enable them to be submitted to these preliminary operations on the part of the corresponding textile machines, fibers must be arranged in the form of a continuous sliver and suitably collected within big cylindrical containers, usually referred to as "cans".

During the processing by one of said textile machines, the sliver is proportionately drawn out of said cans upon the action of feed members associated with the machine and, after being submitted to the corresponding working operation, is laid down again in an orderly manner into other cans. From the last mentioned cans sliver will be fed to another textile machine designed to carry out the next working.

At the present state of the art the presence of an operator is always necessary to achieve the initial engagement of the sliver to the textile machine members. In greater detail, the operator must find out the free end of the sliver in the can and then engage said end to the machine feed members.

Once this operation is performed, the unwinding of the sliver from the can takes place automatically while the working is being carried out by the textile machine which will automatically stop if a lack of sliver between the feed members should be detected, due to the exhaustion of the sliver itself or the accidental breaking of the same. At this point it will be necessary to intervene manually again to restore the machine operation.

The need of said hand interventions gives rise to some problems.

In fact it has been found that, being a single operator generally entrusted with the control of an important number of textile machines, it may happen that the same is unable to promptly intervene so as to restore the operation of a machine which has stopped for one of the above specified reasons.

It has been found as well that the necessity of said hand interventions makes it inconvenient to use modern automatized transferring techniques, by which it would be advantageously possible to achieve the transferring of cans to the different textile machines in a completely automatic manner. Presently said transferring operations are generally carried out by the same operators who are designed to restore the operation of the textile machines.

SUMMARY OF THE INVENTION

Under this situation the main object of the present invention is to eliminate the problems present in the known art by providing an apparatus which, in a completely automatic manner, is capable of finding the free end of the sliver contained in a can and engaging said end between the feed members of a textile machine.

The foregoing and further objects which will become more apparent in the course of the present description are substantially attained by a process to find one end in a textile fiber band or sliver and to engage said end to feed members in a textile machine, said sliver being collected in a sliver can and helically distributed to form primary coils consecutively aligned according to the form of a helix that is wound about the axis of said sliver can to form secondary coils consecutively superposed, said sliver ending at the top in a free end designed to be engaged to to feed members in a textile machine, said process comprising the following stes:

lifting at least one of said primary coils from the sliver can to cause the formation of two sliver lengths descending from the raised coils;

disposing a supporting member alongside one of said descending lengths to move it apart with respect to the other descending length and arrange it so that it engages on either side of the supporting member due to the downward movement of the raised coils;

disengaging the raised coils to achieve the engagement of the length descending on either side of the supporting member;

engaging the sliver to unwinding means acting in the vicinity of the supporting member;

unwinding, by the action of said unwinding means, the primary coils located between the supporting member and the free end until said free end comes close to the supporting member;

transferring the free end close to said feed members so as to achieve the engagement of said end with the latter.

Such process is achieved by an apparatus to find one end in a textile fiber band or sliver and to engage said end to feed members in a textile machine comprising:

a grasping member movable from one position in which it is raised above said sliver can to a second position in which it acts flush with the uppermost secondary coil to engage at least one of said primary coils and lift it from the sliver can due to the grasping member coming back to its first position;

a supporting member movable from a rest position in which it is spaced apart from said feed members to a working position in which it is disposed in the vicinity of the feed members and alongside a sliver length descending from the primary coils which had been raised by the grasping member so that said descending length should be in a spaced apart relationship with respect to said coils and should be ready for engagement on either side of the supporting member due to a downward movement of the raised coils;

unwinding means cooperating with the supporting member to unwind the primary coils located between the supporting member and the free end of the sliver;

stop means to break the action of the unwinding means when the free end comes close to the supporting member;

engagement means to engage the free end of the sliver to the feed members of the textile machine.

BRIEF DESCRIPTION OF THE DRAWINGS

Further features and advantages will best be understood from the detailed description of a process to find the free end of a sliver and to engage said end to the feed members in a textile machine in accordance with the present invention, and of some preferred embodiments of an apparatus to put the process of the invention into practice. Said description will be given hereinafter by way of non-limiting example, with reference to the accompanying drawings, in which.

DESCRIPTION OF THE PREFERRED EMBODIMENTS

Figure 1:
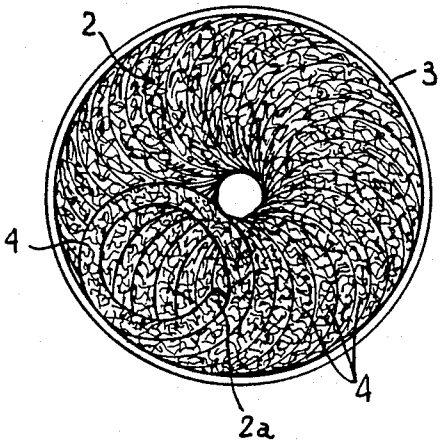
FIG. 1 is a top view of a can containing a sliver distributed thererin in an orderly manner.

Referring particularly to FIGS. 4 to 13, reference numeral 1 globally denotes an apparatus capable of carrying out a process adapted to find one end in a textile fiber band or sliver and engage said end to the feed members of a textile machine in accordance with the present invention.

Apparatus 1 is designed to act on a sliver 2 which, as clearly seen in FIG. 1, is conventionally arranged in an orderly manner at the inside of a cylindrical container or can 3.

In greater detail, sliver 2 is helically wound so as to form a number of primary coils 4 consecutively aligned according to the form of a helix that is wound about the axis of can 3. The helical distribution of primary coils 4 forms a number of consecutively superposed secondary coils, one of which is disposed over all the other coils, as seen in FIG. 1, and terminates in a free end 2*a* of sliver 2.

Figure 2:
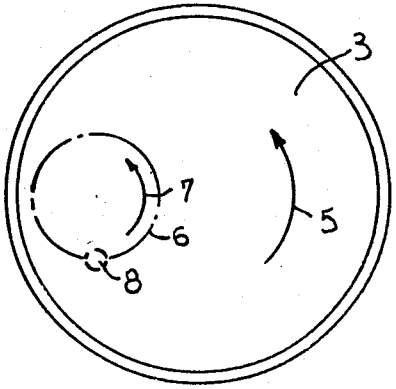
FIG. 2 is a diagrammatic top view of the movements carried out by the can and the members laying down the sliver thereinto to achieve the distribution of said sliver in an orderly manner.

In a manner known per se, the distribution of sliver 2 at the inside of can 3 is the result of the combination of two rotational movements. One of said movements is given by the rotation of can 3 about its own axis in the direction of arrow 5 in FIG. 2 upon the action of a device referred to as "can-turning device". Said rotation of can 3 causes the formation of superposed secondary coils. A second rotational movement is given by a circular path 6 which is eccentric to can 3, taken in the direction of arrow 7 in FIG. 2 by a so-called "mouth" 8 designed to lay down said sliver 2. The second movement, controlled by a device named "mouth-turning device" gives rise to the formation of the primary coils 4.

As clearly seen in FIGS. 4 to 13, can 3 containing sliver 2 is arranged underneath the apparatus 1 the members of which cooperate with the feed members 9 of a textile machine, not shown, to achieve the engagement of the free end 2*a* of sliver 2 between said feed members. In the embodiment shown feed members 9 consist of an idler feed roller 10 and a powered feed roller 11 disposed alongside each other.

The search of the free end 2*a* and the engagement thereof between the feed members 9 take place, according to the present invention, by means of a process comprising the following steps:

lifting at least one of said primary coils from the sliver can to cause the formation of two sliver lengths descending from the raised coils;

disposing a supporting member alongside one of said descending lengths to move it apart with respect to the other descending length and arrange it so that it engages on either side of the supporting member due to the downward movement of the raised coils;

disengaging the raised coils to achieve the engagement of the length descending on either side of the supporting member;

engaging the sliver to unwinding means acting in the vicinity of the supporting member;

unwinding, by the action of said unwinding means, the primary coils located between the supporting member and the free end until said free end comes close to the supporting member;

transferring the free end close to said feed members so as to achieve the engagement of said end with the latter.

Figure 7:
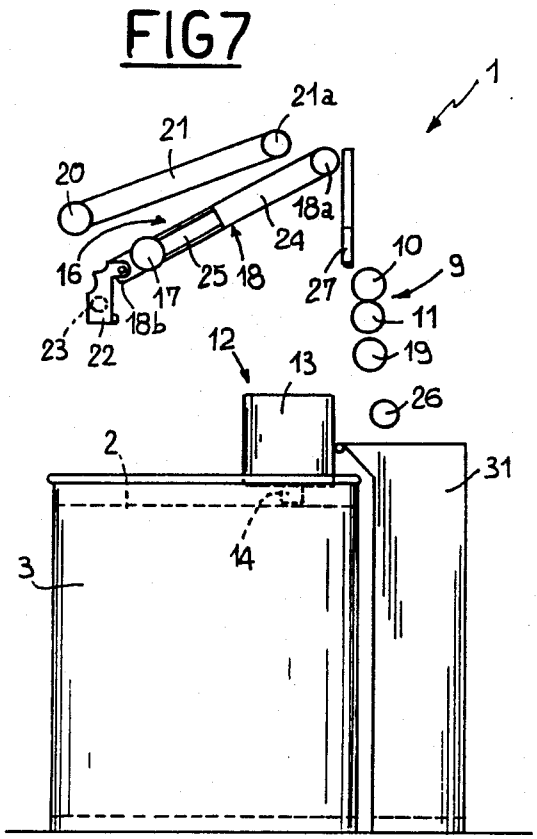
FIG. 7 is a side view of the apparatus with the grasping suction member lowered over the sliver contained in a can.

According to the invention apparatus 1 comprises a grasping member 12 slidably engaged to a supporting frame not shown movable in a substantially vertical direction from a first position in which it is raised above the can 3 to a second position in which, as shown in FIG. 7, it acts flush with the sliver 2 contained in the can to engage at least one of the primary coils 4.

Preferably, the grasping member 12 is comprised of an aspirator 13 provided with a suction mouth 14 directed downwardly, where a vacuum is produced to achieve the engagement of primary coils 4.

Figure 3:
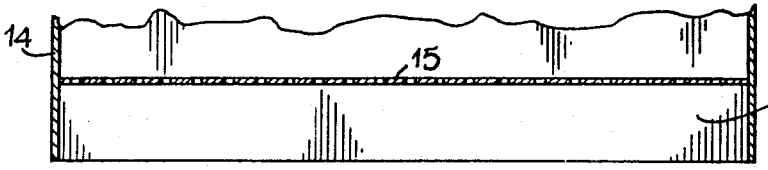
FIG. 3 is an interrupted sectional view, taken along line III—III in FIG. 4 in which the movable grasping member is shown, of the suction mouth exhibited by said grasping member associated with the apparatus of the invention.
Figure 5:
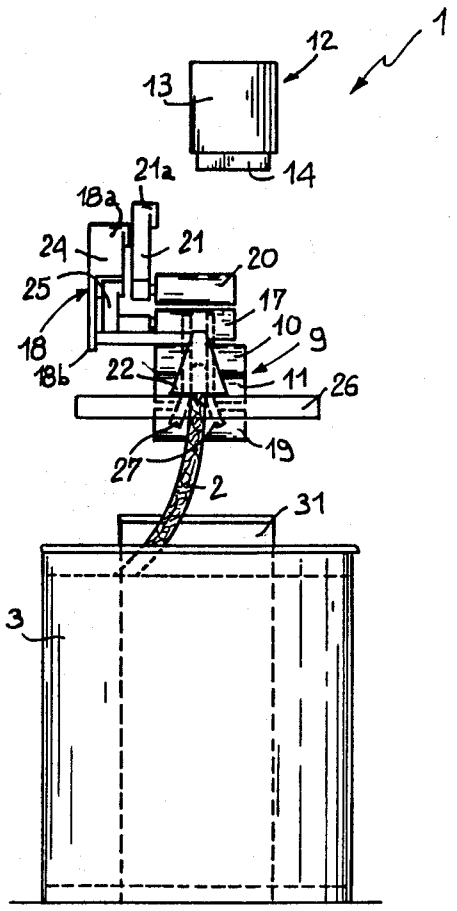
FIG. 5 is a front view of the apparatus in the same conditions as in the preceding figure.

As clearly seen in FIG. 3, the suction mouth 14 substantially has a rectangular-profile tubular section inside which there is a grid-structed protection element 15 made of perforated plate, for example. Said protection element 15 extends transversely, a certain amount far from the free end 14*a* of the suction mouth and enables the suction of air through mouth 14 while preventing the fibers of sliver 2 from being sucked into the aspirator 13 when the engagement of the primary coils 4 takes place.

Figure 4:
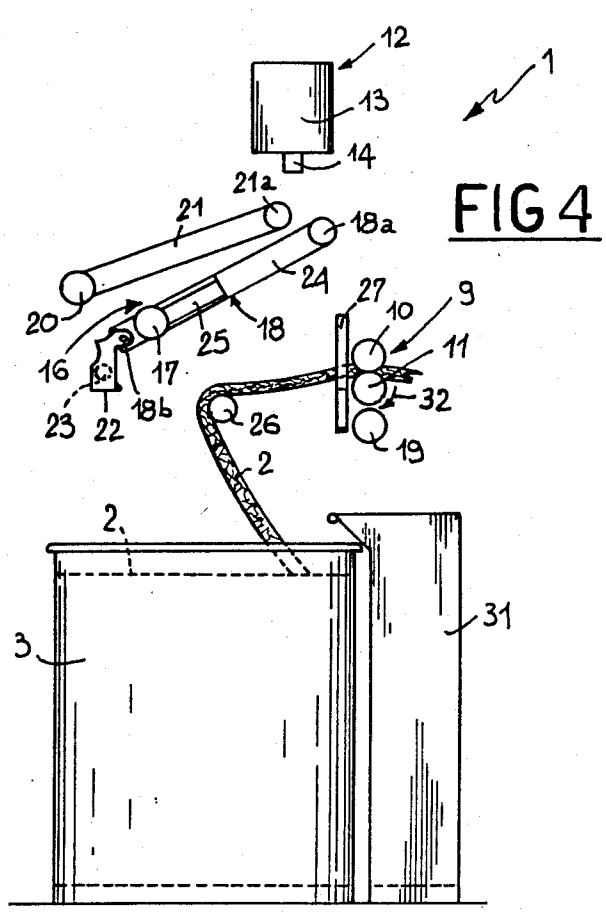
FIG. 4 is a diagrammatic side view of the apparatus in a rest condition, with the sliver being engaged between the feed members of a textile machine.
Figure 9:
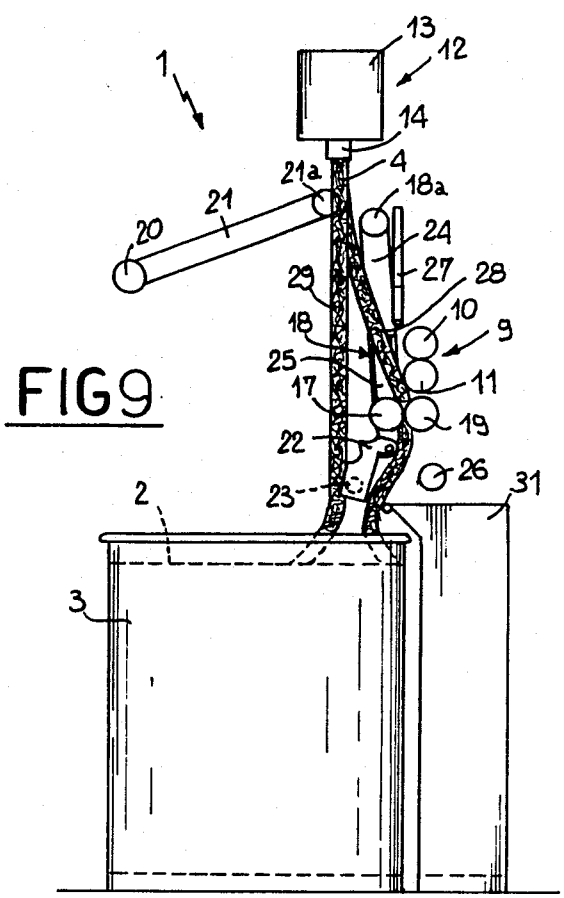
FIG. 9 is a side view of the apparatus in a condition in which a supporting member has been arranged to engage a sliver length descending from the raised coils.

Apparatus 1 further comprises a supporting member 16 movable from a rest position in which, as shown in FIG. 4, it is spaced apart from the feed members 9, to a working position in which, as seen in FIG. 9, it is disposed in the vicinity of said feed members for the reasons to be clarified in the following.

In the embodiment shown the supporting member 16 comprises a supporting roller 17 rotatably engaged to a first arm 18 oscillatably pivoted, at one end thereof, to the supporting frame of the apparatus to bring the supporting roller from a rest position to an operating position. The arrest of motion of arm 18 in the operating position takes place as a result of a contact between the supporting roller 17 and a locating roller 19 rotatably engaged underneath the feed rollers 10 and 11.

Figure 11:
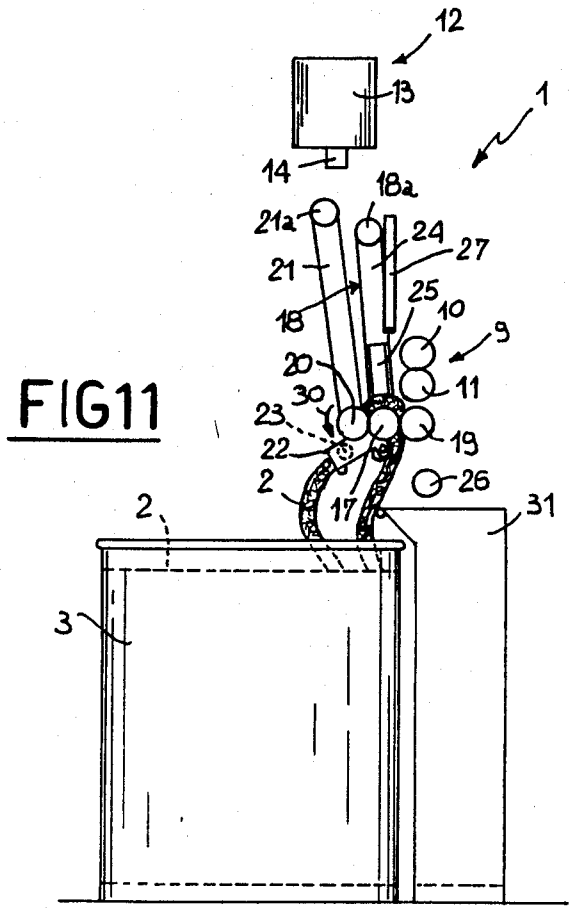
FIG. 11 is a side view of the apparatus in a condition in which the unwinding member cooperates with the supporting member to find out the free end of the sliver.
Figure 10:
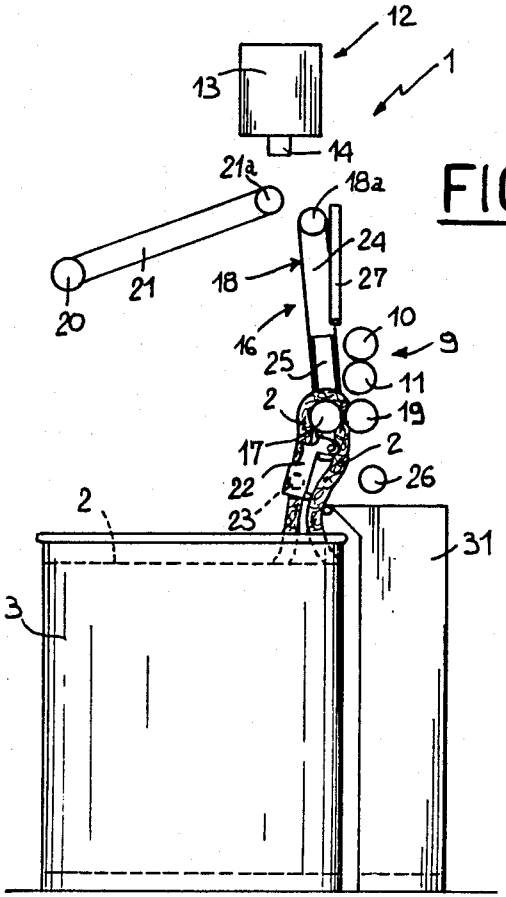
FIG. 10 is a side view of the apparatus after the raised coils have fallen back into the can.

When in its operating condition the supporting roller 17 cooperates with unwinding means to carry out the search of the free end 2*a* of sliver 2. Said unwinding means consists of a powered unwinding roller 20 supported at one end thereof by a second arm 21 the opposite end of which 21*a* is rotatably pivoted to the supporting frame of apparatus 1. Arm 21 enables the unwinding roller 20 to be brought from a rest position in which, as shown in FIG. 4, it is spaced apart from the supporting roller 17, to an operating position in which, as shown in FIG. 11, it acts against the supporting roller to carry out the search of the free end 2*a*.

While the unwinding roller 20 is in operation, sliver 2 is suitably guided through a guide element 22 pivoted to the second end 18*b* of the first arm 18, adjacent the supporting roller 17.

The unwinding means is interlocked to stop means for example consisting of a photoelectric switch 23 associated with the guide element 22 and acting in the region of the supporting roller 17 to stop the operation of the unwinding roller 20 when the free end 2*a* comes close to said supporting roller.

Apparatus 1 further comprises engagement means acting so as to cause the engagement of the free end 2*a* by feed members 9. Still referring to the embodiment shown in FIGS. 4 to 13, said engagement means is achieved by making the first arm 18 in two portions telescopically engaged with each other. In greater detail, one portion 24 is oscillatably pivoted to the supporting frame of the apparatus while the second portion 25 carrying the supporting roller 17 is slidably engaged along the first portion 24.

In accordance with the process of the invention, the operating cycle of apparatus 1 takes place as follows.

During the regular operation of the textile machine, apparatus 1 is at rest, as viewed in FIG. 4. As seen in said figure, while sliver 2 is being proportionately unwound from can 3 upon the action of feed rollers 10 and 11, aspirator 13 keeps a raised position with respect to the can itself and the supporting and unwinding rollers, 17 and 20 respectively, keep their respective rest positions.

Under this situation sliver 2 is conventionally guided upstream of the feed rollers 10 and 11, by a supporting bar 26 holding the sliver over can 3 adjacent the axis thereof. Furthermore a sliver guiding member 27 substantially formed with two upright rods provided in the lower part thereof with portions having a diverging extension, acts close to the feed rollers 10, 11 to keep the sliver trued with respect to said rollers.

Both the supporting bar 2b and sliver guiding member 27 are movable for example upon command of fluid-operated cylinders, along respective guiding elements not shown, to be moved away from the field of action of the members of apparatus 1 when the latter must carry out the engagement of the free end 2a to the feed members 9.

Figure 6:
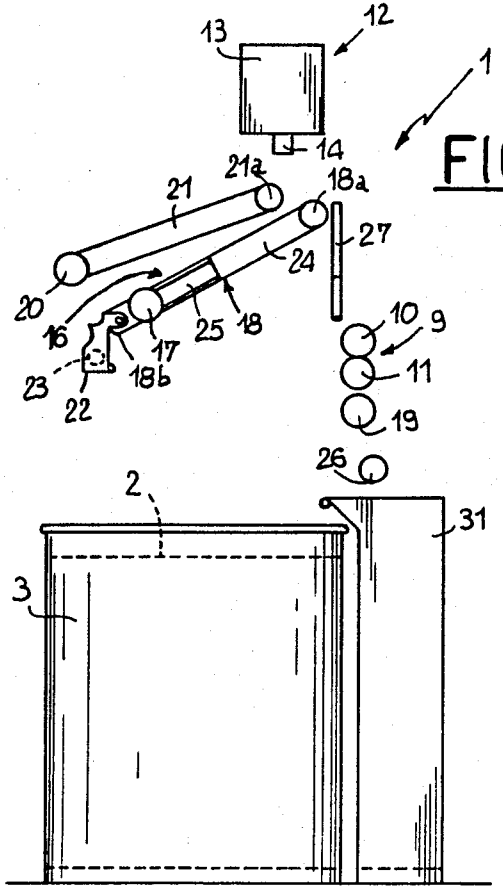
FIG. 6 is a diagrammatic side view of the apparatus with the sliver guiding members spaced apart from the field of action of the other members of the apparatus.

In greater detail, the supporting bar 26 is movable from an operating position in which, as previously said with reference to FIG. 4, it is disposed over the can 3 adjacent the axis of the latter, to a rest position in which, as shown in FIG. 6 for example, it is moved apart from can 3, under the feed rollers 10 and 11 and the locating roller 19. The sliver guiding member 27 instead, is movable from an operating position in which, as viewed in FIG. 4, is disposed in front of the feed rollers 10, 11, to a rest position in which, as shown in FIG. 6, it is raised with respect to the same.

Operation of apparatus 1 preferably takes place upon command of photoelectric sensors acting in known manner close to the feed rollers 10, 11 to cause the operating intervention of the apparatus itself when the absence of sliver 2 between said feed rollers 10, 11 is detected. Other sensors of known type act close to the can 3 to detect whether, when there is no sliver between the feed rollers, the can is completely empty or still contains a certain amount of sliver. If the can is empty, apparatus 1 is not operated until the empty can is replaced with a full can.

According to the operating intervention of apparatus 1, after the supporting bar 26 and sliver guiding member 27 have been brought back to their respective rest positions, there is the activation of aspirator 13 which, is brought, as shown in FIG. 7, from its first to its second position so that the suction mouth 14 rests on some primary coils 4 being part of the uppermost secondary coil. The arrest of the descending motion of aspirator 13 can be for example achieved upon command of a photoelectric switch associated with the suction mouth 14 or upon command of sensors designed to detect the level of sliver 2 contained in can 3.

It will be recognized that the suction mouth 14 rests on some primary coils 4 at randon and that, according to the different cases, said coils may be located more or less spaced apart from the free end 2a. However the primary coils 4 engaged by the suction mouth 14 are included in the last secondary coil disposed at the top of the sliver mass contained in can 3.

The primary coils on which the suction mouth 14 rests are immediately sucked against the stop element 15 and held sideways by the walls of the suction mouth.

Figure 8:
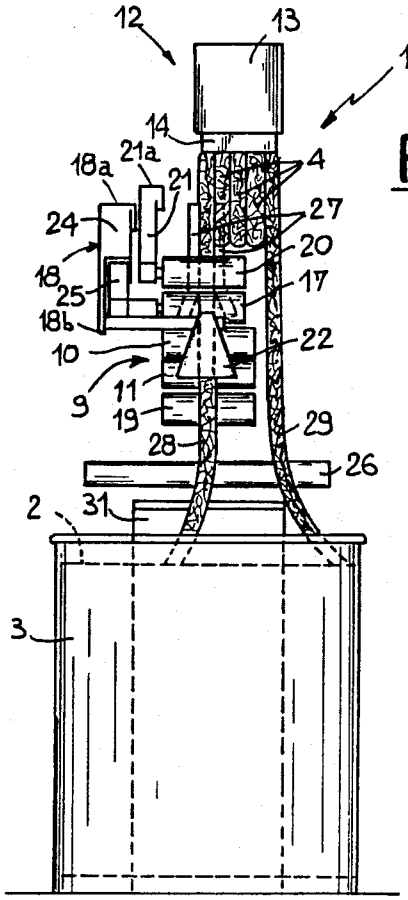
FIG. 8 is a front view of the apparatus in a condition in which the grasping suction member has raised some primary coils formed with the sliver.

Aspirator 13 is then lifted up from can 3 and brought to its first position so as to cause the raising of the primary coils 4 engaged by the suction mouth 14, as clearly shown in FIGS. 8 and 9.

The raising of the primary coils 4 brings about the formation of at least a sliver length descending from said coils. In greater detail, if the raised coils 4 are far enough from the free end 2a of sliver 2, there is the formation of a first descending length 28 connected to the sliver mass 2 extending in the lower part of can 3 and a second descending length 29 which is instead connected to the free end 2a of the sliver. If, on the contrary, the raised primary coils 4 are very close to end 2a, or if said end itself is raised together with the coils, there is the formation of the single descending length 28.

Once the aspirator 13 has carried out the step designed to raise the primary coils 4 in the manner described above, the first arm 18 having its second portion 25 extended past the first portion 24 is rotated about its end 18a upon the action of a fluid-operated cylinder for example, to bring the supporting roller 17 from a rest position to an operating position. During its displacement the supporting roller 17 passes under the grasping member 12 and is then disposed alongside the first descending length 28 in order to cause the latter to be moved away from the raised coils 4 and to be engaged between the locating roller 19 and the supporting roller itself.

It is to be noted that the first descending length 28 engaged by the supporting roller 17 is preferably disposed on the opposite side with respect to the end 2a, taking into account the raised primary coils 4. In this manner the engagement of sliver 2 by the supporting member 16 is ensured even if the free end 2a of the sliver is raised together with the primary coils 4.

When the supporting roller 17 has reached its operating position, aspirator 13 is deactivated so as to cause the disengagement of the raised primary coils 4 which consequently fall back into can 3. Under this situation the first descending length 28 becomes engaged on either side of the supporting roller 17 (see FIG. 10).

After this step, the second arm 21 is rotated about its pivoting end 21a upon the action of a fluid-operated cylinder for example, so as to bring the unwinding roller 20 to its operating position against the supporting roller 17. As shown in FIG. 11, at the end of this step sliver 2 is engaged between the supporting roller 17 and unwinding and locating rollers 20 and 19 respectively, as well as suitably supported by the guide element 22 pivoted on the free end of the first arm 18.

The unwinding roller 20 is then rotated in the direction of arrow 30 in FIG. 11 and, by friction, it pulls along in rotation the supporting roller 17 and locating roller 19 as well. In this way, the unwinding of the primary coils 4 included between the supporting roller 17 and the free end 2a is carried out. Preferably the sliver which is unwound by rollers 20, 17 and 19 is simultaneously and proportionately laid down into an auxiliary container 31 arranged under the feed rollers 10 and 11 and disposed alongside of can 3. It may be also advantageously provided that during this step can 3 be rotated by known means so that the primary coils 4 which are being unwound should be always disposed under the unwinding and supporting rollers 20 and 17. The photoelectric switch 23 causes the arrest of the unwinding roller 20 and consequently the supporting and locating rollers 17 and 19 as soon as the free end 2a goes beyond the contact line between said unwinding and supporting rollers.

Figure 12:
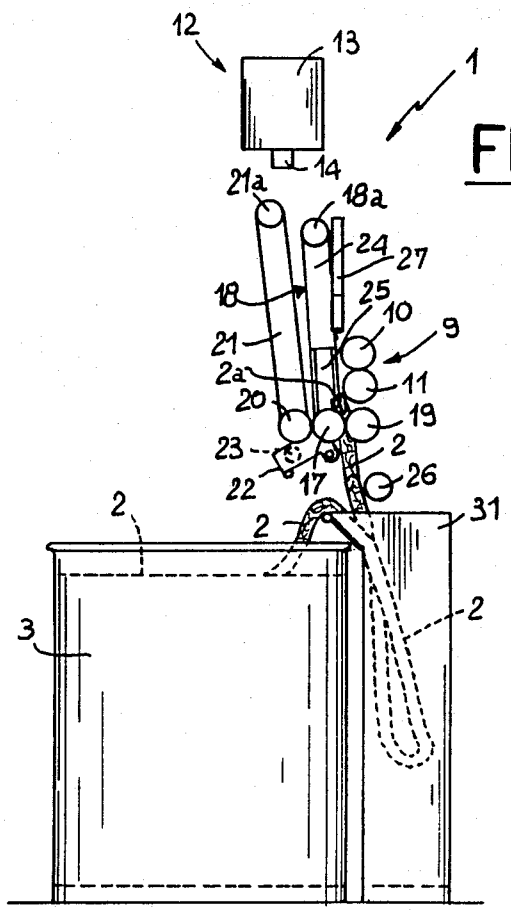
FIG. 12 is a side view of the apparatus in a condition in which the free end of the sliver has reached the supporting member.
Figure 15:
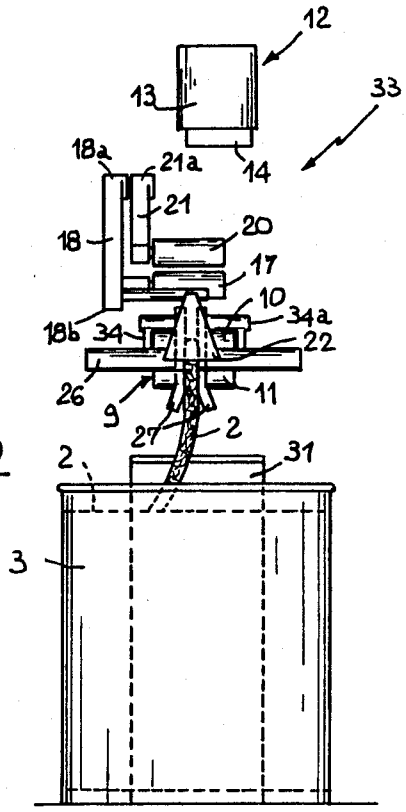
FIG. 15 is a front view of the apparatus in the same conditions as in FIG. 14.

Under this situation, as viewed in FIG. 12, the free end 2a will be held between the supporting roller 17 and locating roller 19 and directed upwardly.

Figure 13:
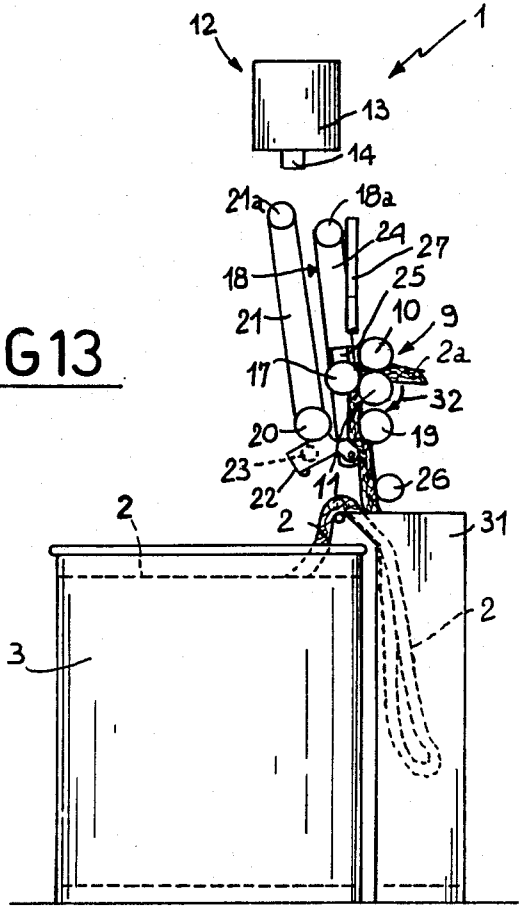
FIG. 13 is a side view of the apparatus in a condition in which the supporting member is raised to engage the free end of the sliver to the feed members of the textile machine.

The second portion 25 of the first arm 18 is now moved towards the interior of the first portion 24 upon command of a fluid-operated cylinder for example, so as to raise the supporting roller 17 and bring it to a position in which, as shown in FIG. 13, it acts against the powered feed roller 11 and is very close to the idler feed roller 10. The free end 2a is involved in the movement of the supporting roller 17 and, at the end of the displacement of said roller, it is engaged in the area defined between the supporting roller and feed rollers 10, 11.

The powered feed roller 11 is then rotated in the direction of arrow 32 in FIG. 13 and by friction it pulls along in rotation the idler feed roller 10 and supporting roller 17. The free end 2a is therefore compelled to pass between the feed rollers 10, 11 and as a result the feeding of sliver 2 to the textile machine is restored.

The operating cycle of apparatus 1 is completed by causing the return of the different members thereof to their respective starting positions shown in FIG. 4. In greater detail, first an angular rotation of arms 18 and 21 occurs so as to move the respective unwinding and supporting rollers 20 and 17 away from the feed rollers 10, 11. Then the sliver guiding member 27 moves downwardly in front of the feed rollers 10, 11 and engages the sliver 2 upstream of the latter while, simultaneously, the supporting bar 26 is brought to its operating position to ensure a regular unwinding of sliver 2. Finally, the second portion 25 of arm 18 is drawn out of the first portion 24, which enables the supporting roller 17 to come back to its rest position.

At the end of the operating cycle of the apparatus sliver 2 can be automatically unwound by the feed rollers 10, 11 as far as either an accidental breaking of the same or its exhaustion require a new intervention of apparatus 1.

FIGS. 14 to 23 show a further embodiment of the apparatus in accordance with the invention, globally identified by reference numeral 33. In said figures all members which have not been modified or replaced with respect to those of the first embodiment hereinbefore described have been allocated the same reference numerals and they will not be further described except when necessary.

Figure 14:
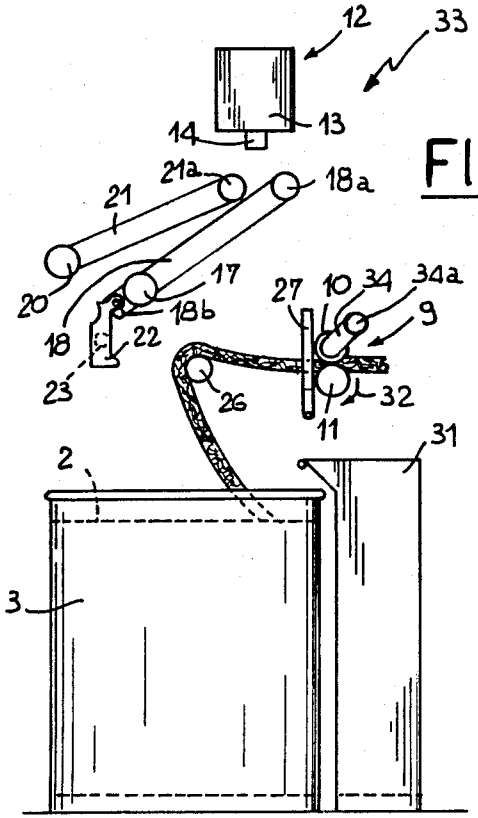
FIG. 14 is a side view of a further possible embodiment of the apparatus in question where the members thereof are disposed in a rest condition and the sliver is engaged by the feed members of the textile machine.
Figure 17:
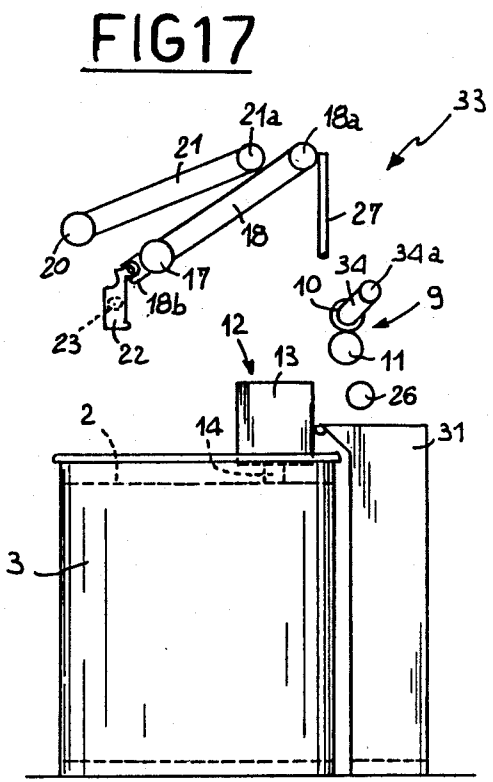
FIG. 17 shows the apparatus as seen in FIG. 14 with the grasping suction member lowered over the sliver contained in a can.
Figure 16:
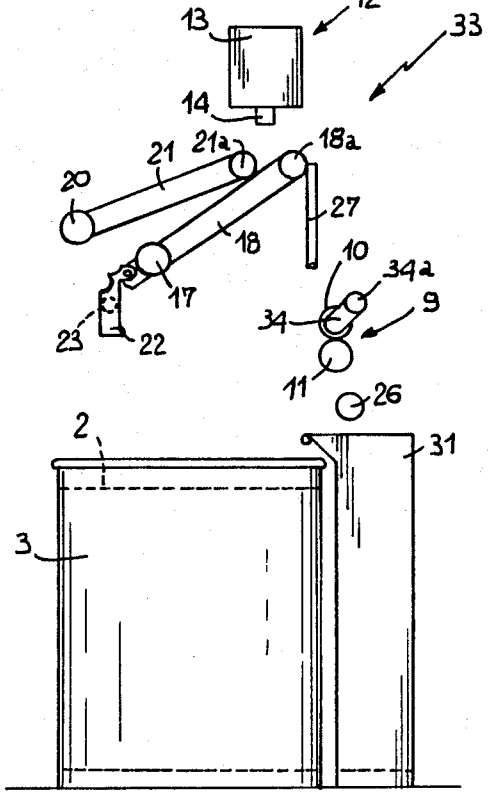
FIG. 16 is a side view of the apparatus shown in FIG. 14 where the members designed to guide the sliver are moved away from the field of action of the other members of the apparatus.
Figure 19:
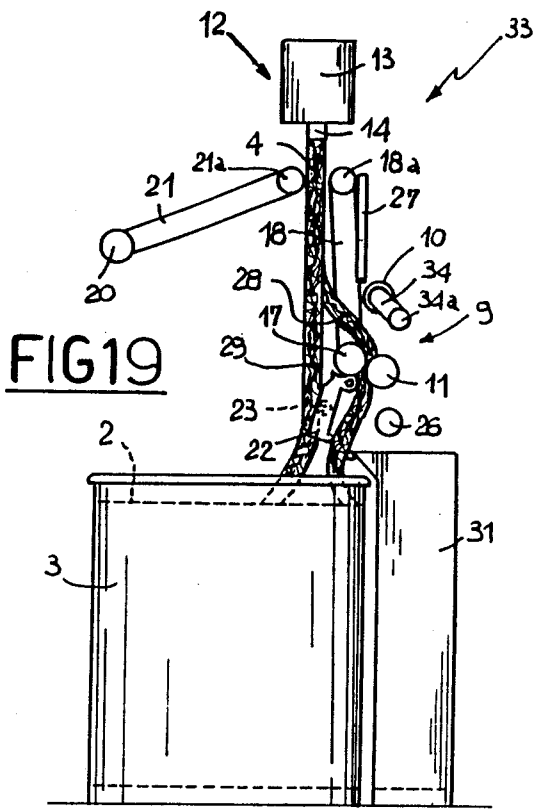
FIG. 19 is a side view of the apparatus shown in FIG. 18 in a condition in which a supporting member has been disposed alongside a sliver length descending from the raised coils.
Figure 18:
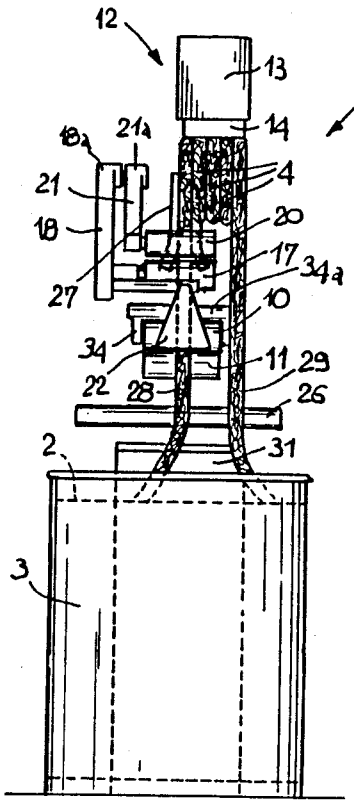
FIG. 18 is a front view of the apparatus shown in FIG. 14 in a condition in which the grasping suction member has raised some coils formed with the sliver.
Figure 21:
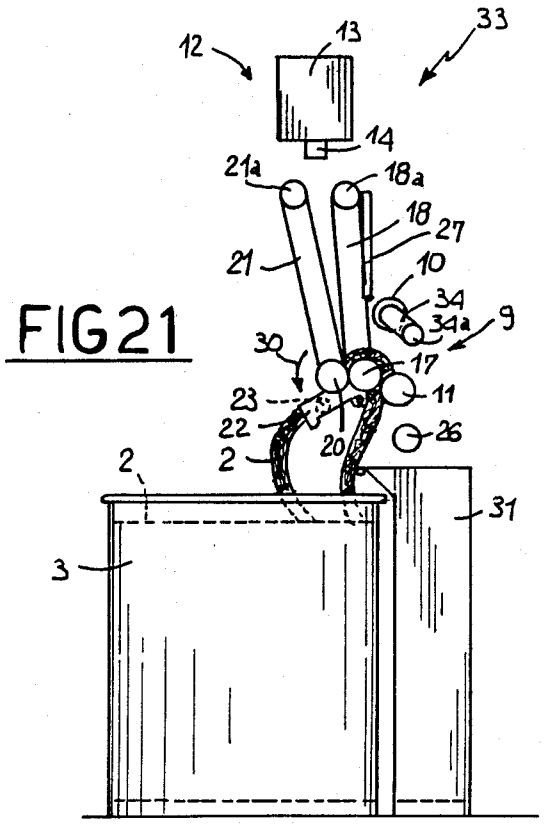
FIG. 21 is a side view of the apparatus as shown in the preceding figure, with an unwinding member cooperating with the supporting member to carry out the search of the free sliver end.
Figure 20:
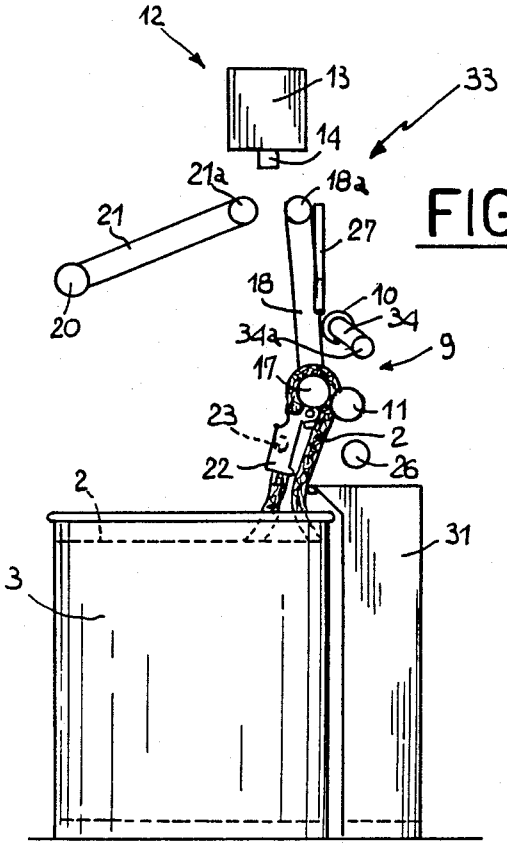
FIG. 20 is a side view of the apparatus after the coils have fallen back into the can.
Figure 23:
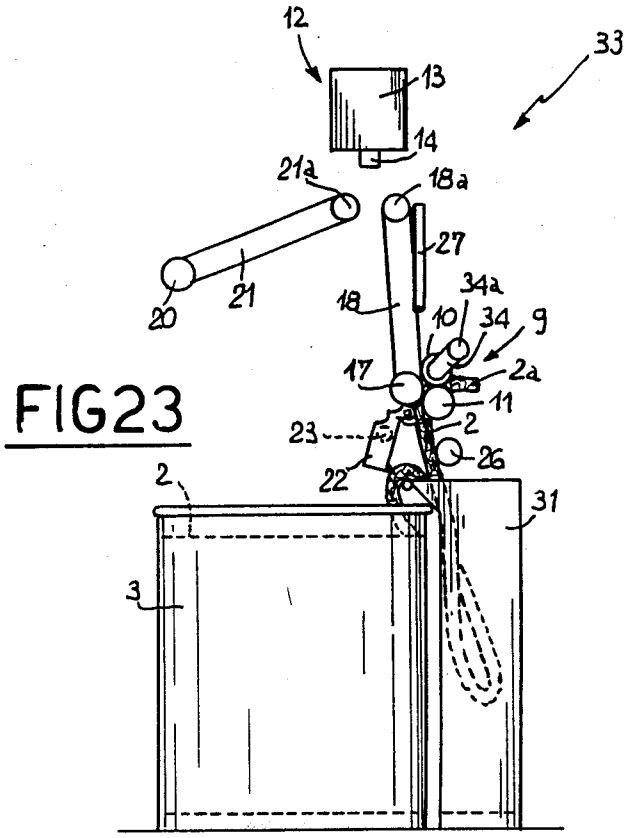
FIG. 23 is a side view of the apparatus shown in FIG. 14 with the free sliver end bieng engaged between the feed members of the textile machine.
Figure 22:
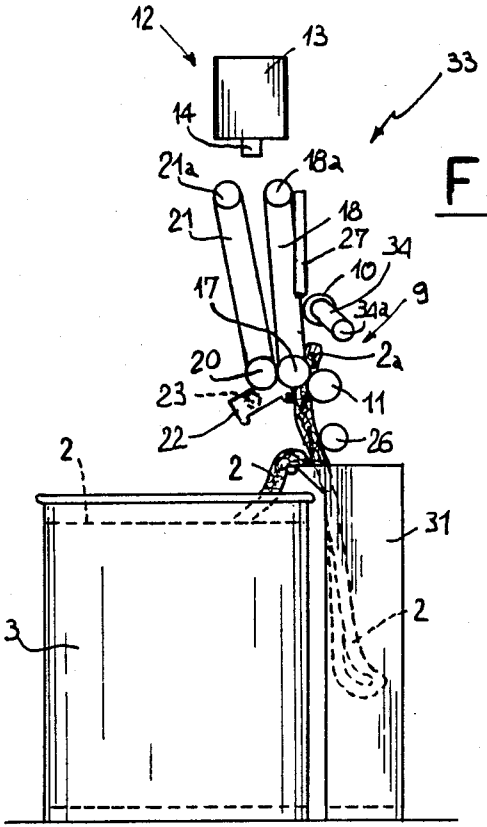
FIG. 22 shows the apparatus viewed in FIG. 14 with the free sliver end disposed close to the supporting member.
Figure 25:
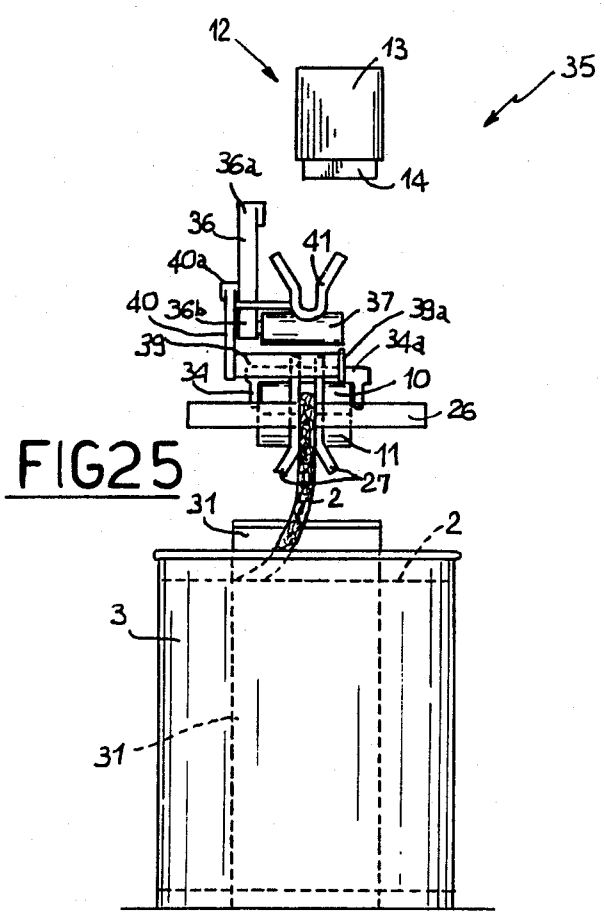
FIG. 25 is a front view of the apparatus as viewed in FIG. 24.
Figure 24:
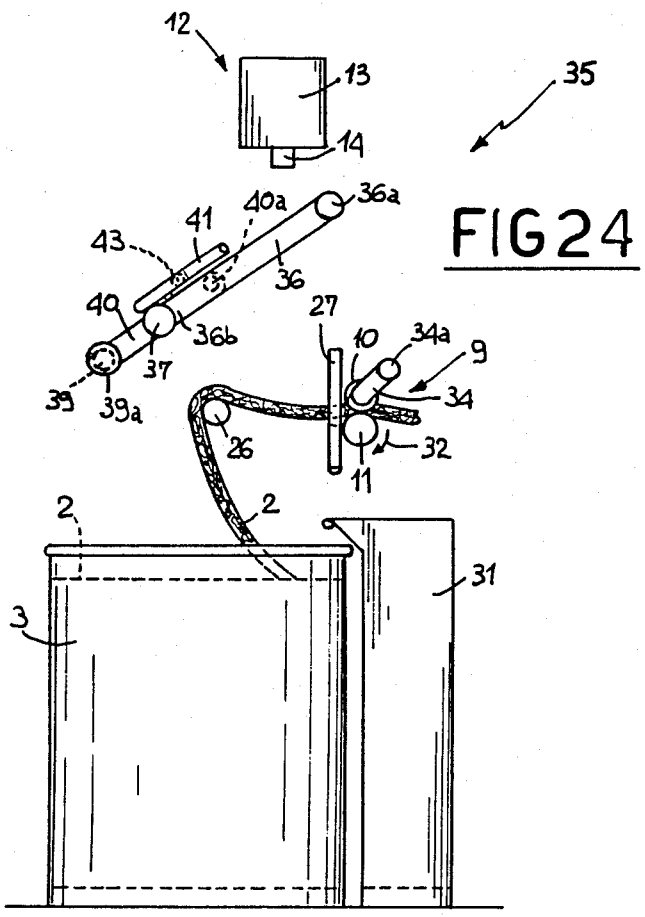
FIG. 24 is a side view showing a further embodiment of the apparatus in a rest condition with the sliver engaged between the feed members of the textile machine.
Figure 27:
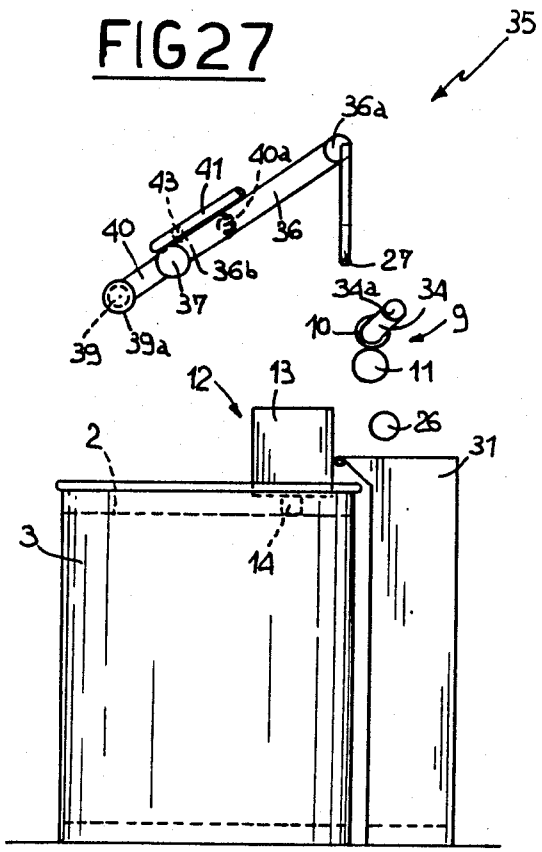
FIG. 27 is a side view of the apparatus shown in FIG. 24 with the grasping suction member lowered over the sliver contained in a can.
Figure 26:
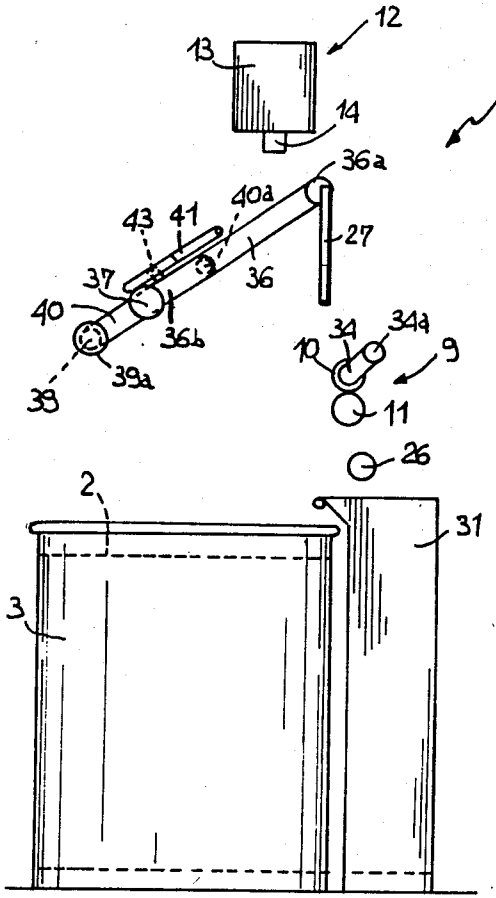
FIG. 26 is a side view of the apparatus shown in FIG. 24 in a condition in which the members designed to guide the sliver are spaced apart from the field of action of the other members of the apparatus.

In said second embodiment the engagement means is not accomplished by the first arm 18 made of two telescopically-engaged portions, but provision is made for the idler feed roller 10 to be mounted on at least a lifting arm 34 oscillatably pivoted to the supporting structure of apparatus 1 or the textile machine frame. The lifting arm 34 can be rotated at an angle about its pivoting axis 34a to bring the feed roller 10 from an operating position in which, as shown in FIG. 14, it acts against the powered feed roller 11, to a rest position in which, as shown in FIG. 19, it is spaced apart from said powered feed roller.

Furthermore when the supporting roller 17 is disposed in its operating position, it acts against the powered feed roller 11 instead of against the locating roller 19, as provided in the preceding embodiment.

When the supporting roller 17 is in its operating position the powered feed roller 11 is made rotatably idle, preferably upon the action of an electromagnetic clutch connecting it to the corresponding driving motor.

In accordance with the operation of apparatus 33, as sequentially shown in FIGS. 14 to 23, once the raising of some primary coils has occurred in the same manner as in the first embodiment, the idler feed roller 10 is brought to its rest position, due to the angular rotation imparted to the lifting arm 34, and the supporting roller 17 is moved to its operating position, i.e. against the powered feed roller 11, due to an angular rotation of the first arm 18. While moving from its rest position to its operating position, the supporting roller 17 takes a path which passes underneath aspirator 13, so as to move close to the first descending length 28 and separate it from the raised coils 4. In this manner, like in the above description, the descending length 34 is arranged to get engaged on either side of the supporting roller 17 when the raised primary coils 4 are dropped into the can 3. Once the engagement of sliver 2 astride of the supporting roller 17 is achieved, the unwinding roller 20 is brought to its operating position and rotated so that, by pulling along in rotation the supporting roller 17 and feed roller 11, it may cause the unwinding of the primary coils 4 included between the supporting roller and the free end 2a.

As previously described, the rotation of the unwinding roller 20 and, as a result, that of the supporting and feed rollers 17 and 11, is in this case too stopped when the free end 2a goes beyond the contact line between the unwinding roller and supporting roller.

At this point the lifting arm 34 is rotated about its pivoting point 34a to bring the idler feed roller 10 to its operating position. As clearly seen in FIG. 23, when the idler feed roller 10 reaches its operating position, the free end 2a is engaged between said idler roller and the powered feed roller 11. The unwinding and supporting rollers 20 and 17 are brought back to their respective rest positions and sliver 2, after being engaged by the supporting bar 26 and sliver guiding member 27, can be unwound by feed rollers 10, 11 while the textile machine is working.

FIGS. 24 to 33 show a further embodiment of the apparatus in accordance with the invention globally identified by reference numeral 35.

In this case too all members which have not been modified or replaced with respect to the other embodiments have been allocated identical reference numerals and will not be hereinafter described except where necessary.

Like in the previously described alternative embodiment, in apparatus 35 as well the idler feed roller 10 is supported by at least a lifting arm 34 and is movable from an operating position in which it acts against the powered feed roller 11 to a rest position in which it is spaced apart from said powered roller.

In the present alternative embodiment arms 18 and 21, as well as their respective supporting and unwinding rollers, 17 and 20, respectively, provided in the preceding embodiments are replaced by a single primary arm 36 having one end 36a rotatably pivoted to the supporting frame of apparatus 35 while the other end 36b supports a powered roller 37 in cantilevered fashion. In this case the arm 36 and roller 37 perform both functions of supporting member and unwinding means for the operation of the apparatus, as more clearly shown in the following.

As previously described with reference to the first arm 18, arm 36 oscillates about the pivoting point of its end 36a to bring the powered roller 37 from a rest position in which it is spaced apart from the feed members 9 to an operating position in which it acts adjacent said members. When in its operating position, roller 37 acts against the powered feed roller 11 which is made idle for example upon the action of an electromagnetic clutch.

Figure 29:
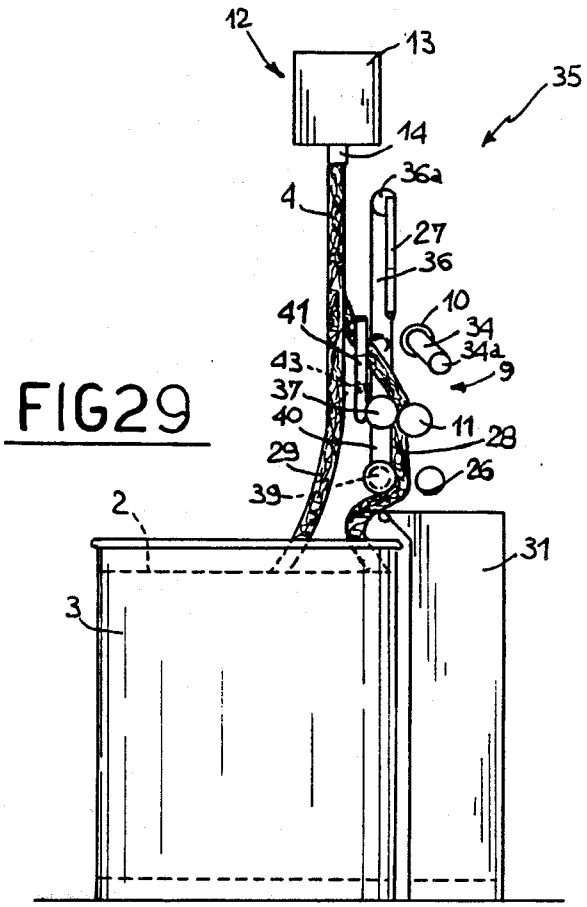
FIG. 29 is a side view of the apparatus as shown in FIG. 28 in a condition in which a supporting member has been disposed alongside a sliver length descending from the raised coils.
Figure 28:
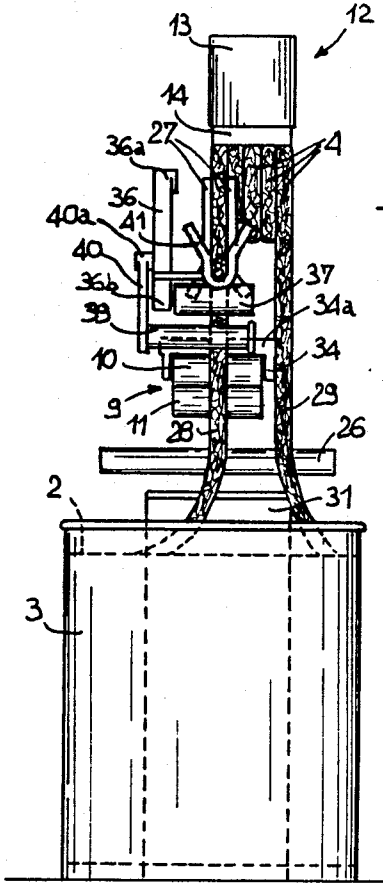
FIG. 28 is a front view of the apparatus as viewed in the preceding figure in a condition in which the grasping suction member has caused the raising of some coils formed with the sliver.
Figure 31:
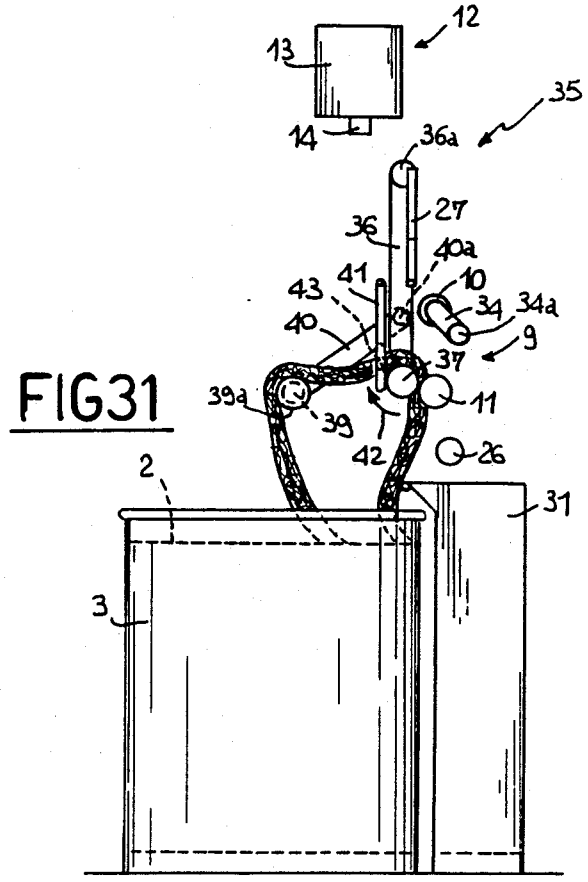
FIG. 31 shows the apparatus in a condition in which the sliver is unwound in order to find out the free end.

Apparatus 35 further comprises an auxiliary supporting bar 39 mounted in cantilevered fashion to one end of supporting arm 40 the opposite end 40a of which is rotatably pivoted to the primary arm 36. The supporting arm 40 is movable about its pivoting point, for example upon command of a fluid-operated cylinder, to bring the auxiliary supporting bar 39 from a first position in which, as shown in FIG. 29, it is arranged to be in vertical alignment with the powered roller 37 and disposed thereunder when the latter is in its operating position, to a second position in which, as shown in FIG. 31, it is sideways moved apart from the powered roller 37, on the opposite side with respect to the feed members 9.

In accordance with the operation of apparatus 35, sequentially shown in FIGS. 24 to 33, after the raising of the primary coils 4 has occurred, the primary arm 36 is rotated about its pivoting axis to bring the powered roller 37 to its operating position against the powered feed roller 11, which is made idle in the same manner as previously described.

During its displacement the powered roller 37 comes alongside of the first descending length 28 and laterally separates it from the raised coils 4 pushing it against the feed roller 11.

Figure 30:
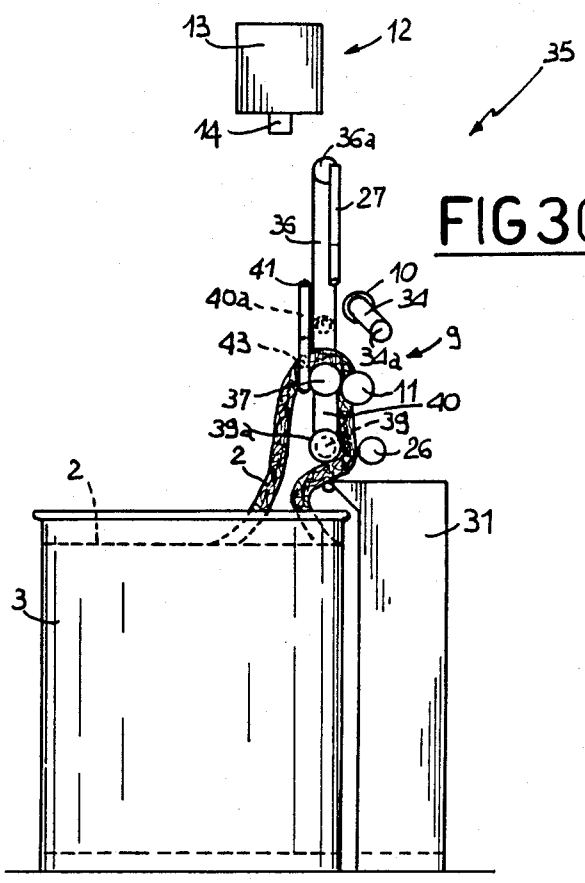
FIG. 30 is a side view of the apparatus with the sliver being engaged on either side of the supporting member.
Figure 33:
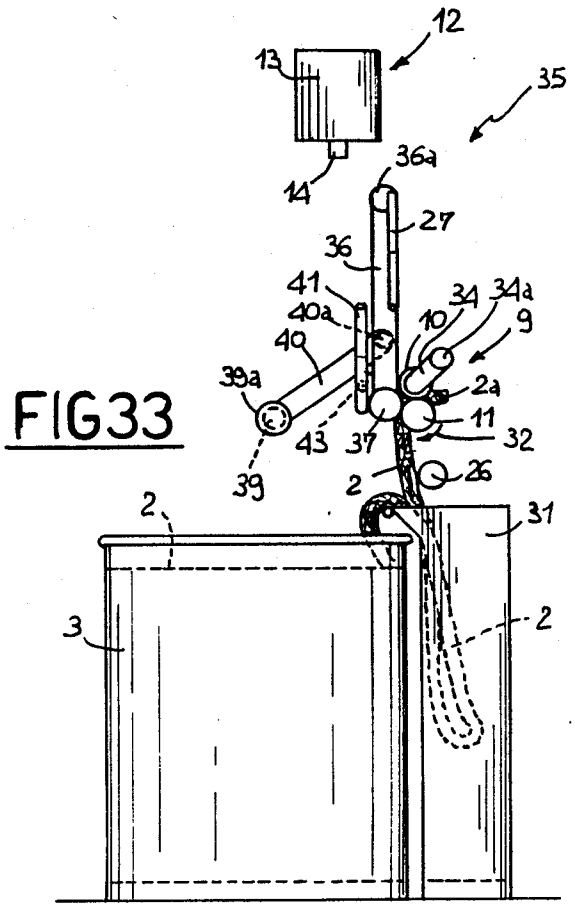
FIG. 33 shows the apparatus as viewed in the preceding figure when the free end is engaged between the feed members of a textile machine.
Figure 32:
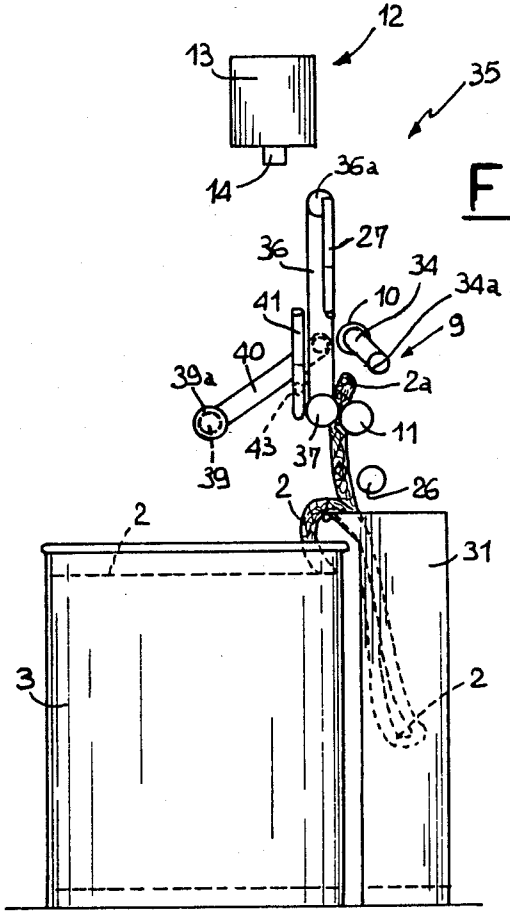
FIG. 32 is a side view of the apparatus with the free sliver end being engaged in the region of the supporting member.

When the raised coils 4 are dropped into the can 3, the first descending length 28 engages on either side of the powered roller 37. Advantageously the presence of an auxiliary sliver guiding member 41 may be provided, which is supported in cantilevered fashion by the primary arm 36 and, as clearly seen in FIG. 25, has a U-shaped configuration in which the two ends are diverging. Said auxiliary member 41 is designed to engage the first descending length 28 when the raised primary coils 4 fall into the can 3, as shown in FIGS. 29, 30, 31.

The auxiliary supporting bar 39 which has been till now in its first position, is moved to its second position by an angular rotation imparted to the supporting arm 40. Under this situation the auxiliary supporting bar 39 engages the sliver 2 and supports it in the region of the axis of can 3, upstream of the powered roller 37.

The powered roller 37 is then driven in rotation in the direction of arrow 42 in FIG. 31 and, as a result, it pulls along in rotation the feed roller 11 to produce the unwinding of the primary coils 4 included between the powered roller 37 and the free end 2*a*. During this unwinding step the sliver is suitably guided by the supporting bar 39 and the sliver guiding member 41 and, as it occurs in the previously described embodiments, it is proportionately laid down into the auxiliary container 31. Preferably the auxiliary supporting bar 39 is provided at its free end opposite the supporting arm 40, with a circular ridge 39*a* adapted to prevent sliver 2 from falling down during the unwinding. The rotation of the powered roller 37, and therefore the feed roller 11, is immediately stopped, for example upon command of a photoelectric switch 43 acting close to the auxiliary sliver guiding member 41, when the free end 2*a* reaches said powered roller. When rollers are stopped the free end 2*a* is held therebetween and directed upwardly so that it can be engaged between the powered feed roller 11 and idler feed roller 10 when the latter is brought back to its operating position. Once this operation has occurred, the different members of apparatus 35 sequentially take their respective starting positions and the textile machine begins working again while sliver 2 is being progressively unwound from can 3 upon the action of feed rollers 10, 11.

The present invention attains the intended purposes.

With the process and apparatus of the invention it is in fact possible to carry out in a completely automatic manner the search of the free end of the sliver gathered in a can and the engagement of said end between the feed members of a corresponding textile machine, in order to restore the operation of said machine.

Thanks to the completely automatic accomplishment of these operations, the time necessary to bring the textile machine into operation again is relatively short and it is possible to eliminate the long down times present in the textile machines of the known art when the feeding of sliver is for example stopped, and at that moment the operator is unable to attend to its restauration at once.

Furthermore and advantageously, due to the elimination of all hand operations, it is possible to greatly exploit modern automatic techniques in order to carry out the transferring of cans to the different textile machines.

Obviously, the invention as conceived is susceptible of many modifications and variations all falling within the scope of the inventive idea characterizing it.

What is claimed is:

1. A process to find one end in a textile fiber band or sliver and to engage said end to feed members in a textile machine, said sliver being collected in a sliver can and helically distributed to form primary coils consecutively aligned according to the form of a helix that is wound about the axis of said sliver can to form secondary coils consecutively superposed, said sliver ending at the top in a free end designed to be engaged to feed members in a textile machine, wherein said process comprises the following steps:

lifting at least one of said primary coils from the sliver can to cause the formation of two sliver lengths descending from the raised coils;

disposing a supporting member alongside one of said descending lengths to move it apart with respect to the other descending length and arrange it so that it engages on either side of the supporting member due to the downward movement of the raised coils;

disengaging the raised coils to achieve the engagement of the length descending on either side of the supporting member;

engaging the sliver to unwinding means acting in the vicinity of the supporting member;

unwinding, by the action of said unwinding means, the primary coils located between the supporting member and the free end until said free end comes close to the supporting member;

transferring the free end close to said feed members so as to achieve the engagement of said end with the latter.

2. The process as claimed in claim 1, wherein said supporting member is disposed alongside the descending length which, taking into account the raised coils, is located on the opposite side with respect to the free end of the sliver.

3. The process as claimed in claim 1, wherein the raised primary coils belong to the last secondary coil disposed over the sliver mass contained in said sliver can.

4. An apparatus to find one end in a textile fiber band or sliver and to enage said end to feed members in a textile machine, said sliver being collected in a sliver can and helically distributed to form primary coils consecutively aligned according to the form of a helix that is wound about the axis of said sliver can to form secondary coils consecutively superposed, said sliver ending at the top in a free end designed to be engaged to feed members in a textile machine, comprising:

a grasping member movable from one position in which it is raised above said sliver can to a second position in which it acts flush with the uppermost secondary coil to engage at least one of said primary coils and lift it from the sliver can due to the grasping member coming back to its first position;

a supporting member movable from a rest position in which it is spaced apart from said feed members to a working position in which it is disposed in the vicinity of the feed members and alongside a sliver length descending from the primary coils which had been raised by the grasping member so that said descending length should be in a spaced apart relationship with respect to said coils and should be ready for engagement on either side of the supporting member due to a downward movement of the raised coils;

unwinding means cooperating with the supporting member to unwind the primary coils located between the supporting member and the free end of the sliver;

stop means to break the action of the unwinding means when the free end comes close to the supporting member;

engagement means to engage the free end of the sliver with the feed members of the textile machine.

5. The apparatus as claimed in claim 4, wherein said grasping member is comprised of an aspirator provided with a downward facing suction mouth where a vacuum is produced in order to cause the raised primary coils to adhere to the suction mouth iteself.

6. The apparatus as claimed in claim 4, wherein said supporting member is comprised of at least a supporting roller rotatably engaged in cantilevered fashion with one arm which is rotatably hinged at one of its ends and angularly oscillatable about its pivoting axis to bring the supporting roller from a rest position to a working position.

7. The apparatus as claimed in claim 6, wherein said supporting roller when in its working position acts against a locating roller rotatably engaged below the feed members of the textile machine.

8. The apparatus as claimed in claim 6, wherein a guide element is oscillatably hinged to said first arm, which element is designed to engage the sliver extending on either side of the supporting roller in order to guide it upstream of the supporting roller itself.

9. The apparatus as claimed in claim 4, wherein said unwinding means comprises at least a powered unwinding roller carried by a second arm rotatably supported at one of its ends and angularly oscillatable to bring the unwinding roller from a rest position in which it is spaced apart from the supporting roller to a working position in which it acts against the supporting roller to unwind the sliver engaged on either side thereof.

10. The apparatus as claimed in claim 4, further comprising an auxiliary container located below the feed members and disposed alongside said sliver can to collect the sliver unwound by the action of the unwinding means.

11. The apparatus as claimed in claim 4, wherein said stop means comprises at least a photoelectric switch operating in the region of the supporting member to detect the absence of sliver thereon.

12. The apparatus as claimed in claim 4, wherein said engagement means comprises one arm carrying the supporting member, said arm consisting of a first portion having its end rotatably hinged and being angularly oscillatable to bring the supporting member from a rest position to a working position, and a second portion telescopically guided along the first portion and engaging said supporting member, said second portion being movable towards the first portion to cause the lifting of the supporting member when the latter is in its working position so that it is brought into working engagement with the feed member.

13. The apparatus as claimed in claim 4, further comprising a supporting bar movable from a rest position in which it is laterally spaced apart from the sliver can to a working position in which it is located over the can, adjacent the axis of the same, to support the sliver as it is unwound from the can by the action of the feed members.

14. The apparatus as claimed in claim 4, wherein said engagement means comprises at least a lifting arm rotatably hinged at one end thereof and at the other end rotatably engaging an idler feed roller being part of said feed members, said lifting arm being angularly oscillatable about its pivoting axis to bring the idler feed roller from a rest position in which it is raised with respect to a powered feed roller being part of said feed members as well, to a working position in which the idler feed roller acts against the powered feed roller.

15. The apparatus as claimed in claim 6, wherein said supporting roller, when in its working position, acts against a feed roller being part of said feed members.

16. The apparatus as claimed in claim 15, wherein said feed roller is powered when the apparatus is inactive and can be operatively disengaged from the respective driving motor so that it is made to idle during the operating intervening of the apparatus itself.

17. The apparatus as claimed in claim 4, wherein both said supporting member and unwinding means consist of a primary arm supporting a powered roller in cantilevered fashion and being oscillatably hinged at one end thereof, to bring the powered roller itself from a rest position to a working position, when in its working position said powered roller acting against a feed roller being part of said feed members.

18. The apparatus as claimed in claim 17 wherein, hinged to said primary arm, is a supporting arm carrying an auxiliary supporting bar in cantilevered fashion and being oscillatable about its pivoting point on the primary arm to bring the auxiliary supporting bar from one position in which it is designed to be vertically aligned with the powered roller and located thereunder when said powered roller is in its working position, to a second position in which said auxiliary bar is laterally spaced apart from said powered roller and located on the side opposite said feed members.

* * * * *